US006431939B1

(12) United States Patent
Roh et al.

(10) Patent No.: US 6,431,939 B1
(45) Date of Patent: Aug. 13, 2002

(54) HULA HOOP

(76) Inventors: Seoung June Roh; Jung Sik Roh, both of 575 (10/4) Ockryun-dong, Yunsu-ku, Inchun-si (KR)

( * ) Notice: Subject to any disclaimer, the term of this patent is extended or adjusted under 35 U.S.C. 154(b) by 0 days.

(21) Appl. No.: 09/654,983

(22) Filed: Sep. 5, 2000

(30) Foreign Application Priority Data

Sep. 7, 1999 (KR) ..... 99-18935
Sep. 16, 1999 (KR) ..... 99-19995

(51) Int. Cl.[7] ..... A63H 1/100
(52) U.S. Cl. ..... 446/236
(58) Field of Search ..... 446/236, 239, 446/242, 243, 267, 450, 453, 489; 601/118, 132, 128, 129; 482/131

(56) References Cited

U.S. PATENT DOCUMENTS 3,900,984 A * 8/1975 Garelick ..... 446/486
3,918,708 A * 11/1975 Augusta ..... 446/265
3,956,851 A * 5/1976 Tapinekis ..... 446/267
4,897,069 A * 1/1990 Overturf ..... 446/219
5,338,244 A * 8/1994 Huang ..... 446/242
5,442,869 A * 8/1995 McDarren et al. ..... 446/358
5,569,134 A * 10/1996 Nordanger ..... 446/110
5,823,846 A * 10/1998 Arriola et al. ..... 446/236
6,059,632 A * 5/2000 Sassak ..... 446/236

* cited by examiner

*Primary Examiner*—Jacob K. Ackun
*Assistant Examiner*—Faye Francis
(74) *Attorney, Agent, or Firm*—Cooper & Dunham LLP

(57) ABSTRACT

A hula hoop is disclosed. In this hula hoop, the tubular hoop body 10 has an annular, polygonal or floral profile and contains a fluid filler 20, such as a liquid- or solid-phase fluid filler, within its cavity 30 while leaving an empty space in the cavity 30, thus being improved in its functional effect when used for physical exercise or in play due to a dynamic movement of the filler 20 within the cavity 30 during a rotating action of the hoop body about the body of a user. In the hula hoop of this invention, the fluid filler 20 is selected from water, brine, metal balls having a predetermined diameter, infrared radiation particles, and particular magnets. In addition, the fluid filler may consist of solid particles and liquid. In an embodiment, the hoop body 10 is fabricated using a plurality of modules, designed to be assembled and disassembled.

5 Claims, 8 Drawing Sheets

HULA HOOP

BACKGROUND OF THE INVENTION

1. Field of the Invention

The present invention relates, in general, to hula hoops and, more particularly, to a hula hoop having an annular, polygonal or floral shape and containing a fluid filler, such as a liquid- or solid-phase fluid filler, within its tubular body while leaving an empty space in the body, thus being improved in its functional effect when used for physical exercise or in play.

2. Description of the Prior Art

Hula hoops were initially introduced in the 1950s and have been widely used for physical exercise or in play by men and women of all ages.

However, conventional hula hoops have a simple profile and a simple construction, such that they are made of hollow or solid plastic pipes and have simply annular profiles having fixed diameters. Therefore, such annular hula hoops are not sufficient in their functional effect when used for physical exercise, and so they are only used as auxiliary sporting goods for simple waist exercise. In addition, the conventional hula hoops are limited in their playing method, such that the hoops are simply rotated about the waist, and so most people may easily become bored while playing with the hoop.

In an effort to overcome such problems by improving the functional effect of hula hoops when using the hoops for physical exercise or in play, a variety of hula hoops have been proposed and used in the prior art.

For example, Korean Utility Model Laid-open Publication No. 97-467 discloses "A weight adjustable hula hoop". In this hula hoop, a plurality of weight adjusting screws may be selectively set along the inside surface of the hoop body by a user, thus allowing the user to easily adjust the weight of the hoop by adding or removing a desired number of screws. The weight adjusting screws, set along the inside surface of the hoop body, are also used as skin contact tips capable of improving the skin and muscle massaging and stimulating effect of the hoop when rotating the hoop about the waist.

However, the above weight adjustable hula hoop, having a plurality of weight adjusting screws, regrettably has the same simply annular profile as those of the above-mentioned conventional hula hoops, and so the hula hoop lacks effective improvement in its functional effect when used for physical exercise or in play. Furthermore, the weight adjusting screws of the above hula hoop may be insufficiently finished at their surfaces and project toward the body of a user while rotating about the body, thus sometimes injuring the body of the user playing with the hoop.

Another example of conventional hula hoops may be referred to Korean Utility Model Laid-open Publication No. 99-3801 disclosing "A coil ring hula hoop with enforced playing effect". This hula hoop is made of a coil ring, and so the diameter of the hoop smoothly varies due to centrifugal force acting on the hoop when the hoop is rotated about the body of a user at a high speed, thus improving the functional effect of the hoop when the hoop is used in play.

However, the above coil ring hula hoop is problematic in that it is not improved in its functional effect when it is used for physical exercise, since it is only designed to improve its playing effect without considering any improvement in the physical exercising effect.

A further example of conventional hula hoops may be referred to Korean Utility Model Laid-open Publication No. 99-33378 disclosing "A hula hoop with skin and muscle massaging and stimulating tips". In this hula hoop, a plurality of skin and muscle massaging and stimulating tips are regularly set along the inside surface of the hoop body, thus improving the skin and muscle massaging and stimulating effect of the hoop when rotating the hoop about the waist at sufficient speed. However, this hula hoop is only a simple modification of "the weight adjustable hula hoop" disclosed in Korean Utility Model Laid-open Publication No. 97-467, thereby having problems similar to those described for the weight adjustable hula hoop.

In addition to the above-mentioned hula hoops, a variety of hula hoops designed to enhance their functional effect when used for physical exercise or in play have been proposed and used. For example, luminous hula hoops, sounding hula hoops, luminous and water-whistle hula hoops, and ping-pong ball hula hoops have been proposed in the prior art.

SUMMARY OF THE INVENTION

Accordingly, the present invention has been made keeping in mind the above problems occurring in the prior art, and an object of the present invention is to provide a hula hoop, which has an annular, polygonal or floral shape and contains a fluid filler, such as a liquid- or solid-phase fluid filler, within its tubular body while leaving an empty space in the body, thus being improved in its functional effect when used for physical exercise or in play.

In order to accomplish the above object, the present invention provides a hula hoop, comprising a tubular hoop body having an annular, polygonal or floral profile, with a fluid filler contained in the cavity of the tubular hoop body while leaving an appropriate empty space in the cavity.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
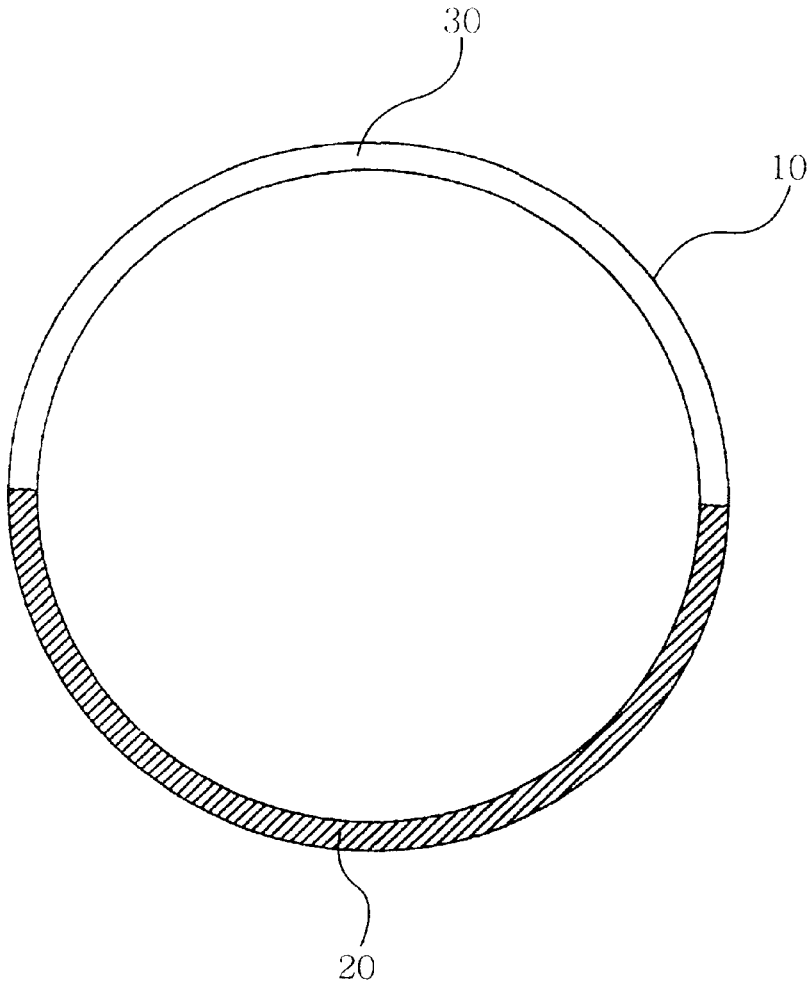
FIG. 1 is a front view of an annular hula hoop in accordance with the primary embodiment of the present invention.

FIG. 1 is a front view of an annular hula hoop in accordance with the primary embodiment of the present invention. As shown in the drawing, the hula hoop according to the primary embodiment of this invention comprises an annular tubular hoop body 10, preferably made of a hollow plastic pipe shaped into a desired annular profile, with a fluid filler 20 contained in the cavity 30 of the annular hoop body 10 while leaving an empty space in the cavity 30.

That is, the annular hoop body 10 is a large-diameter ring-shaped tubular body, preferably made of a hollow plastic pipe.

On the other hand, the fluid filler 20 may be selected from proper liquid-phase fillers, such as water or brine, and appropriate solid-phase fillers, such as metal balls. In the present invention, far infrared radiation particles having a particle size of not larger than a predetermined size, such as elvan particles, charcoal particles and ceramic particles, may be preferably used as the fluid filler 20.

In addition, small-sized magnets may also be preferably used as the fluid filler 20.

When a plurality of metal balls having a predetermined diameter are used as the filler 20, the fluidity of the filler 20 is remarkably improved since such metal balls are somewhat heavy and can actively roll within the tubular hoop body 10. The metal balls, used as the fluid filler 20 of the hoop, remarkably improve the functional effect when the hoop is used for physical exercise.

In the present invention, it is necessary to contain the filler 20 in the tubular hoop body 10 while leaving a predetermined empty space within the cavity 30 of the body 10.

In such a case, it is preferable to contain the filler 20 in a way such that the filler 20 occupies a half of the volume of the cavity 30 or less as shown in FIG. 1.

When containing the filler 20 in the entire cavity 30 of the tubular hoop body 10 without leaving any empty space in the cavity 30, it is impossible for the filler 20 to desirably flow or roll within the hoop body 10, but rather only to undesirably increase the weight of the body 10, thus failing to achieve the target object of this invention. In the present invention, it is thus necessary to contain the filler 20 in the tubular hoop body 10, such that the filler 20 only occupies ⅓ to ½ of the volume of the cavity 30 while leaving a predetermined empty space within the cavity 30 of the body 10, thus allowing the filler 20 to have a desired fluidity and to actively move within the cavity 30.

Of course, it should be understood that the desired operational effect of the filler 20 of this invention may be accomplished by containing both a liquid-phased filler and a solid-phase filler in the cavity 30 at the same time.

Figure 2:
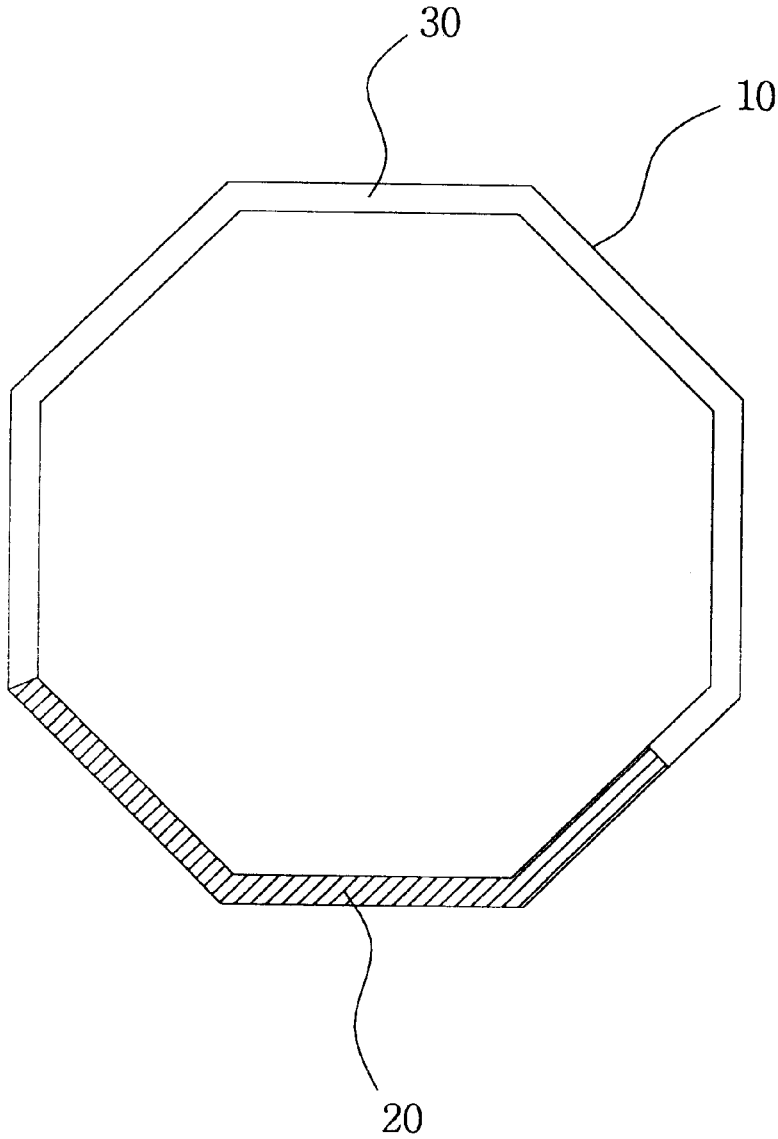
FIG. 2 is a front view of a polygonal hula hoop in accordance with the second embodiment of the present invention.

FIG. 2 is a front view of a polygonal hula hoop in accordance with the second embodiment of the present invention.

In this embodiment, the tubular hoop body 10 has an octagonal profile, with a filler 20 being contained in the cavity 30 of the tubular hoop body 10 while leaving an empty space in the cavity 30.

In this second embodiment, the general construction of the hula hoop remains the same as that of the hula hoop of the primary embodiment except for the fact that the hoop body 10 has a polygonal profile.

In addition, the filler 20, contained in the hoop body 10, is preferably selected from liquid- or solid-phase fluid fillers in the same manner as that described for the primary embodiment.

In the present invention, the containing of the filler 20 within the cavity 30 of the hoop body 10 may be accomplished by two methods as follows: That is, a predetermined amount of filler 20 may be contained in the cavity 30 of the tubular hoop body 10 to occupy ⅓ to ½ of the volume of the cavity prior to jointing the ends of the body 10 together into a single structure with a completely sealed cavity 30 during a process of manufacturing the hula hoop. In such a case, the amount of filler 20 is fixed. Alternatively, the hoop body 10 may be designed to allow a user to easily and freely control the amount of filler 20 contained in the body 10 as desired.

When using the hula hoop for physical exercise or in play by rotating the hoop about the body of a user at some speed, the filler 20 is apt to centrifugally move within the cavity 30 of the hoop body 10 in a direction opposite to the direction of rotation of the hoop body 10, and to centrifugally lean to a tangential direction of a large-diameter track circle formed by the hoop body 10 continuously rotated about the waist. In addition, the portion of the hoop body 10 in contact with the waist continuously varies during the repeated rotating action of the hoop body 10 about the waist, thus allowing a positional movement of the filler 20 within the cavity 30. This finally allows the filler 20 to actively flow or roll within the cavity 30 of the hoop body 10.

During such a repeated rotating action of the hoop body 10 about the waist of a user, the filler 20 continuously and centrifugally flows or rolls within the cavity 30 so as to lean to a position farthest away from the rotating axis of the hoop body 10. Due to such a centrifugal flowing or rolling action of the fluid filler 20 within the tubular hoop body 10, the physical exercising effect of the hula hoop acting on the body of the user is enhanced.

In addition, the hoop body 10 according to the second embodiment has a polygonal profile, and so the hula hoop of this embodiment accomplishes both a desired dynamic rotating action and an enhanced physical exercising effect, which are not expected from the conventional simply annular hula hoops, in addition to the above-mentioned centrifugal flowing or rolling action of the fluid filler 20 within the cavity 30.

Figure 3A:
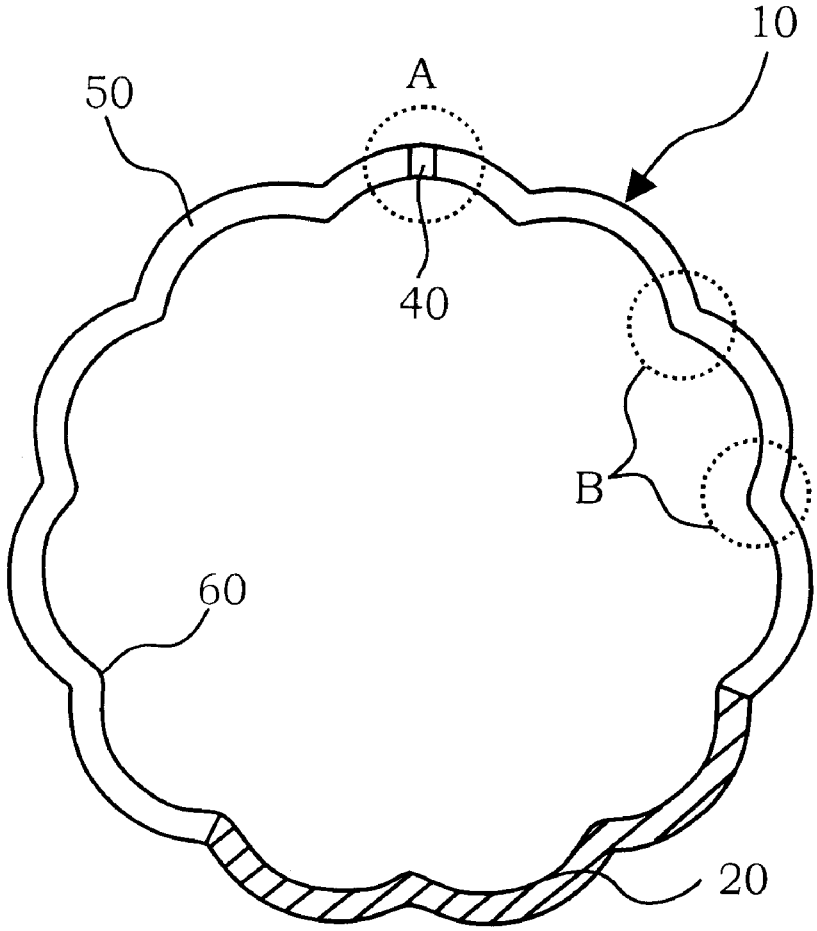
FIG. 3A is a front view of a floral hula hoop in accordance with the third embodiment of the present invention.

FIG. 3A is a front view of a floral hula hoop in accordance with the third embodiment of the present invention. As shown in the drawing, the hoop body 10 according to the third embodiment has a floral profile.

That is, the floral profile of the tubular hoop body 10 according to the third embodiment is accomplished by a plurality of outward arc-shaped portions 50 continuously and integrally formed along the body 10.

In the hula hoop of the third embodiment, a plurality of inwardly bent portions 60 are formed at the junctions of the outward arc-shaped portions 50, respectively. That is, the arc-shaped portions 50 and the bent portions 60 are alternately formed along the floral hoop body 10.

In the same manner as that described for the primary and second embodiments, a fluid filler 20 is contained in the cavity of the floral hoop body 10 while leaving an empty space in the cavity.

Figure 4:
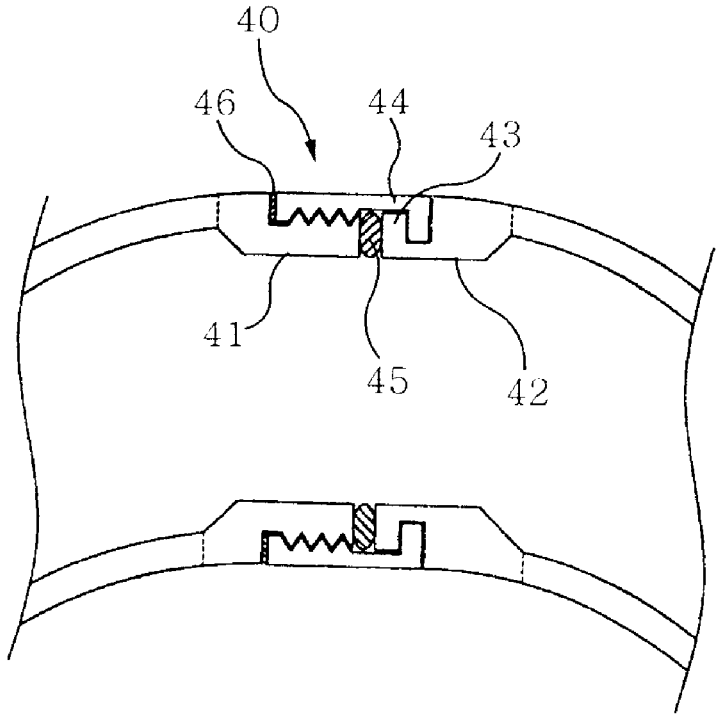
FIG. 4 is a sectional view of the portion "A" of FIG. 3, showing the construction of a screwed joint of the floral hula hoop of this invention.

In the third embodiment of this invention, a screwed joint 40 may be formed on at least one arc-shaped portion 50 of the floral hoop body 10 as best seen in FIG. 4.

The above screwed joint 40 is used for removably joint the opposite ends of the body 10 into a desired single floral body, and collaterally allows a user to selectively add or remove a desired amount of filler 20 into or from the cavity of the hoop body 10 as desired.

FIG. 4 is a sectional view of the portion "A" of FIG. 3A, showing the construction of the screwed joint 40 of the floral hoop body 10.

As shown in the drawing, the screwed joint 40 comprises a first end 41, a second end 42, a union nut 44, and a sealing ring 45. The first and second ends 41 and 42 are the opposite ends of the floral hoop body 10, and are jointed together by the union nut 43 through a screw-type jointing process, with the sealing ring 45 being closely interposed between the two ends 41 and 42 to achieve a desired sealing effect.

In the above screwed joint 40, the first end 41 is stepped to be reduced in its outer diameter, and is externally threaded on its cylindrical surface having the reduced outer diameter.

On the other hand, the second end 42 is opposite to the first end 41, and has an external annular stop flange 43 at its tip.

The union nut 44 engages with the stop flange 43 of the second end 42 at one end thereof in a way such that the nut 44 is not allowed to be unexpectedly removed from the second end 43, but is only allowed to be rotatable around the stop flange 43. The other end of the nut 44 extends to a length corresponding to the length of the externally-threaded tip of first end 41, and is internally threaded. The above nut 44 engages with the externally-threaded tip of first end 41, and accomplishes a desired screw-type jointing of the two ends 41 and 42.

When the two ends 41 and 42 of the floral hoop body 10 are jointed together by the nut 44, the sealing ring 45 is closely interposed between the two ends 41 and 42 to achieve a desired sealing effect at the jointed junction. Due to the sealing ring 45, it is possible to almost completely prevent an undesired leakage of the fluid filler 20 from the jointed junction between the two ends 41 and 42.

A second sealing ring 46, such as a rubber packing, may be preferably set in the annular gap between the end surface of the first end 41 and an associated surface of the union nut 44, thus further improving the sealing effect of the jointed junction between the two ends 41 and 42.

When the floral hula hoop of this invention is provided with such a screwed joint 40 at a desired position of the hoop body 10, it is possible to form the hoop body 10 as a module. In such a case, the module is assembled into a desired hoop body 10 by a user as follows: That is, the first end 41 is primarily aligned with the second end 42, having the idle-rotatable union nut 44, so as to face each other. Thereafter, the union nut 44, having the internal threads, is rotated at an appropriate number of times to be tightly fastened to the externally-threaded tip of the first end 41. The desired hoop body 10 is thus easily assembled or disassembled by a user as desired.

The floral hula hoop of this invention may be provided with two or more screwed joints 40 at regular positions of the hoop body 10. In such a case, it is possible to fabricate the desired hoop body 10 using two or more modules.

Of course, such a screwed joint 40 may be adapted to the hula hoops according to the primary and second embodiments without affecting the functioning of the hula hoops.

Figure 5:
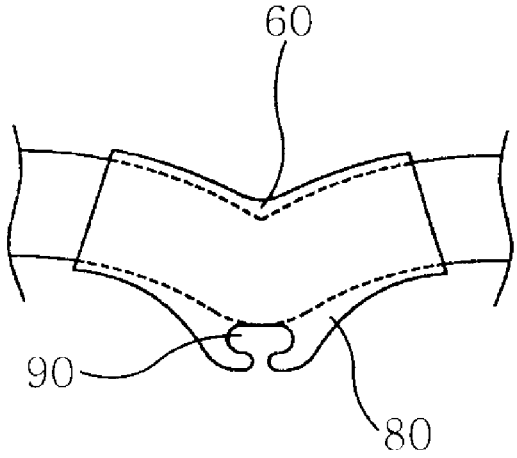
FIG. 5 is a sectional view of the portion "B" of FIG. 3, showing the construction of a specifically designed rubber pad fitted over each bent portion of the floral hula hoop of this invention.

FIG. 5 is a sectional view of the portion "B" of FIG. 3A, showing the construction of a hula hoop in accordance with a modification of the third embodiment.

In the hula hoop according to the modification of FIG. 3A, a specifically designed rubber pad 80 is fitted over each inwardly bent portion 60 of the floral hoop body 10.

The above rubber pads 80 further improve the physical exercising effect primarily provided by the bent portions 60 of the floral hoop body 10 while rotating the hoop about the body of a user at some speed. A collateral operational effect of the rubber pads 80 is to prevent the hoop body 10 from undesirably slipping down the body of a user.

It is preferable to form a vertical slit locking hole 90 on each rubber pad 90.

The locking hole 90 is more preferably formed on the inside portion of each rubber pad 80, at which the pad 80 comes into contact with the body of a user while rotating the hoop body 10 about the body of the user.

The above locking hole 90 of each rubber pad 80 is used for holding an infrared radiation tip, such as a ceramic tip or a jade tip, or holding a magnetic tip. The above-mentioned infrared radiation tips provide a magnetic massage effect and actively promote blood circulation, while the jade or ceramic tips provide a vital wave vibration effect. When such infrared radiation or magnetic tips are held on the locking holes 90 of the hoop body 10 as described above, it is possible to give a magnetic massage effect and a vital wave vibration effect to the body of a user in addition to an improved physical exercising effect.

The operational effect of the above-mentioned hula hoops of this invention will be described in detail herein below.

In order to use, for example, the floral hula hoop of FIG. 3A for physical exercise or in play, the hoop body 10 is rotated about the waist of a user in either direction at an appropriate speed by swinging the hips.

The tubular hoop body 10 contains a fluid filler 20, such as water, brine, small-sized metal balls or solid particles, in its cavity while leaving a sufficient empty space in the cavity.

Of course, it is possible for the user to freely select a desired fluid filler 20 from a variety of liquid- or solid-phase fluid fillers and to selectively add or remove a desired amount of filler 20 into or from the cavity of the hoop body 10, thus accomplishing an optimal physical exercising effect in addition to an optimal playing effect of the hula hoop.

Figure 6:
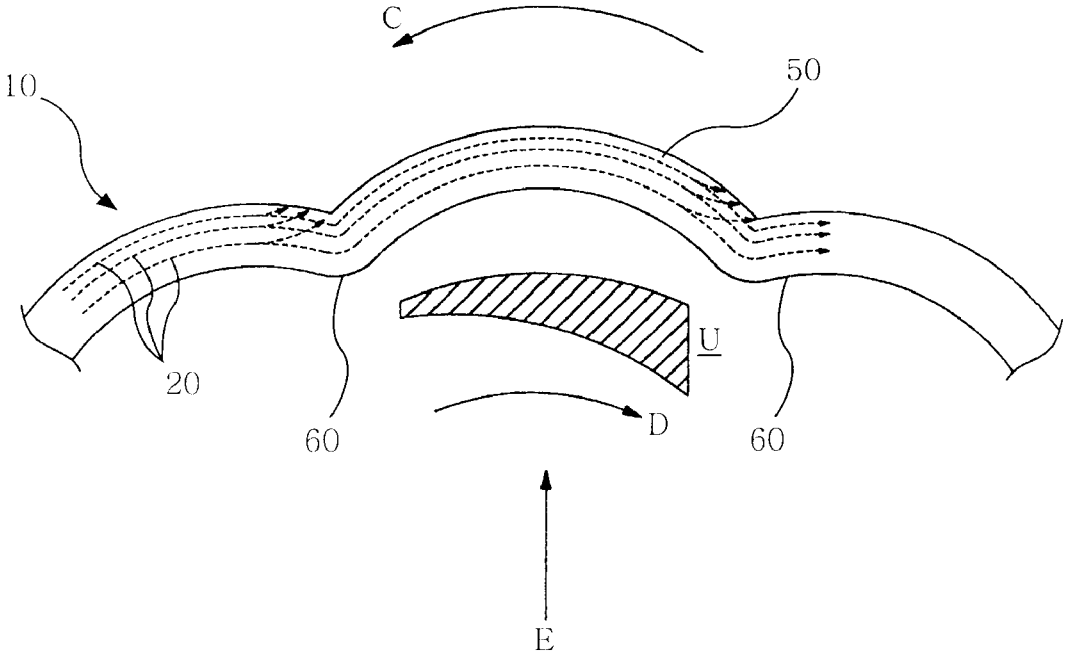
FIG. 6 is a view, showing the fluid action of a filler contained within the floral hula hoop of this invention when playing with the hula hoop.

When the hoop body 10, containing the fluid filler 20 therein, is rotated about the waist in either direction, for example, in a counterclockwise direction as shown by the arrow "C" of FIG. 6, at an appropriate speed by swinging the hips, the filler 20 is apt to centrifugally move within the cavity of the hoop body 10 in a clockwise direction as shown by the arrow "D" of FIG. 6.

Since the centrifugal force continuously acts on the filler 20 within the hoop body 10 during the rotating action of the body 10 about the waist, the filler 20 always leans to a position farthest away from the rotating axis of the hoop body 10. In such a case, the centrifugal force acting on the filler 20 forces the filler 20 to actively lean to the outer portion of the sidewall of the hoop body 10 rather than the inner portion of the sidewall at the position farthest away from the rotating axis of the body 10.

In addition, the fluid filler 20 forces the rotating floral hoop body 10 to highly loaded at the bent portions 60, since the bent portions 60 disturb a smooth movement of the filler 20 within the hoop body 10. That is, when rotating the floral hoop body 10 about the waist at an appropriate speed, the centrifugal movement of the fluid filler 20 within the tubular hoop body 10 is primarily disturbed by a bent portion 60, thus allowing the body 10 to be highly loaded by a higher concentration of the filler 20 at that bent portion. Due to a continued rotating action of the hoop body 10, the load, acting on the hoop body 10 by the filler 20, is gradually reduced at an arc-shaped portion 50 next to the bent portion 60, and is gradually increased prior to being highly increased at a next bent portion 60. Such a variation in the load, acting on the floral hoop body 10 by the fluid filler 20, is continuously repeated at every vent portion 60 and at every arc-shaped portion 50 while the hoop body 10 is rotated about the waist.

Such a gradual variation in the load, acting on the floral hoop body 10 by the fluid filler 20 within an arc-shaped portion 50 while playing with the hoop, is shown by the shaded diagram "U" of FIG. 6.

Due to both the movement of the filler 20 in the direction "D" and the weight of the hoop body 10, the rotating hoop body 10 is biased outwardly in a radial direction as shown by the arrow "E" of FIG. 6.

When playing with the floral hula hoop of FIG. 3A, the fluid filler 20 is apt to continuously move in the direction "D" due to inertial force. However, such an inertial movement of the filler 20 is disturbed by each bent portion 60, thus allowing the hoop body 10 to be momentarily and dynamically vibrated at each bent portion 60. Therefore, the rotating floral hoop body 10 repeatedly transmits such dynamic vibration to the body of a user at its bent portions 60.

Figure 3B:
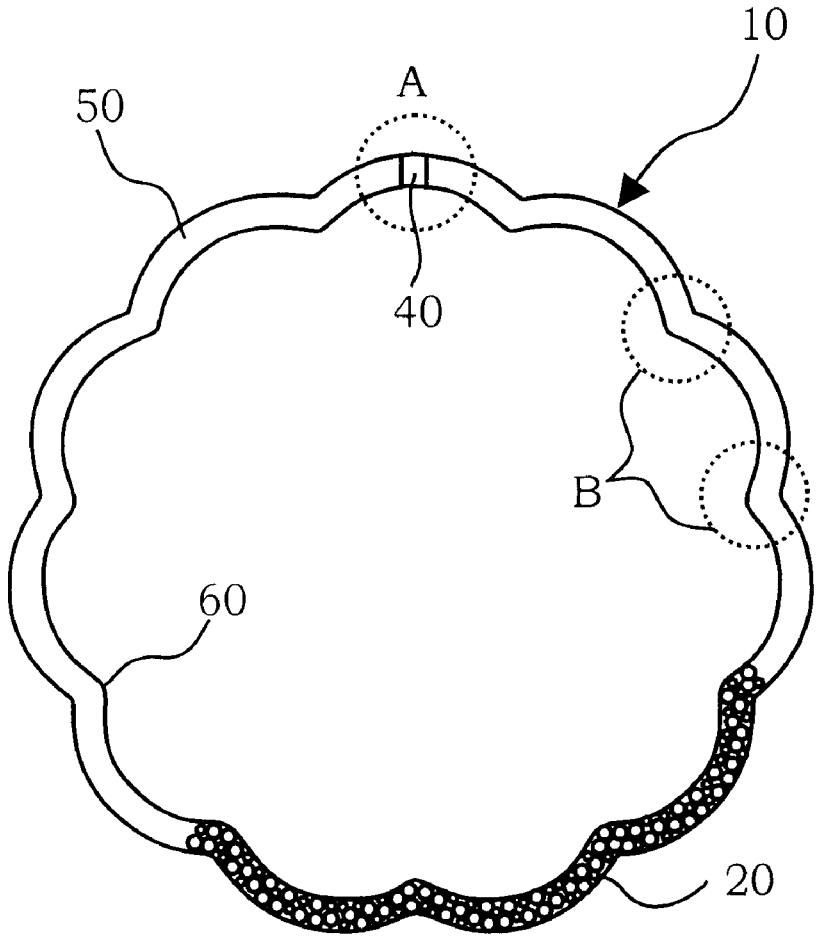
FIG. 3B is a front view of a floral hula hoop having metal balls in accordance with the third embodiment of the present invention.
Figure 3C:
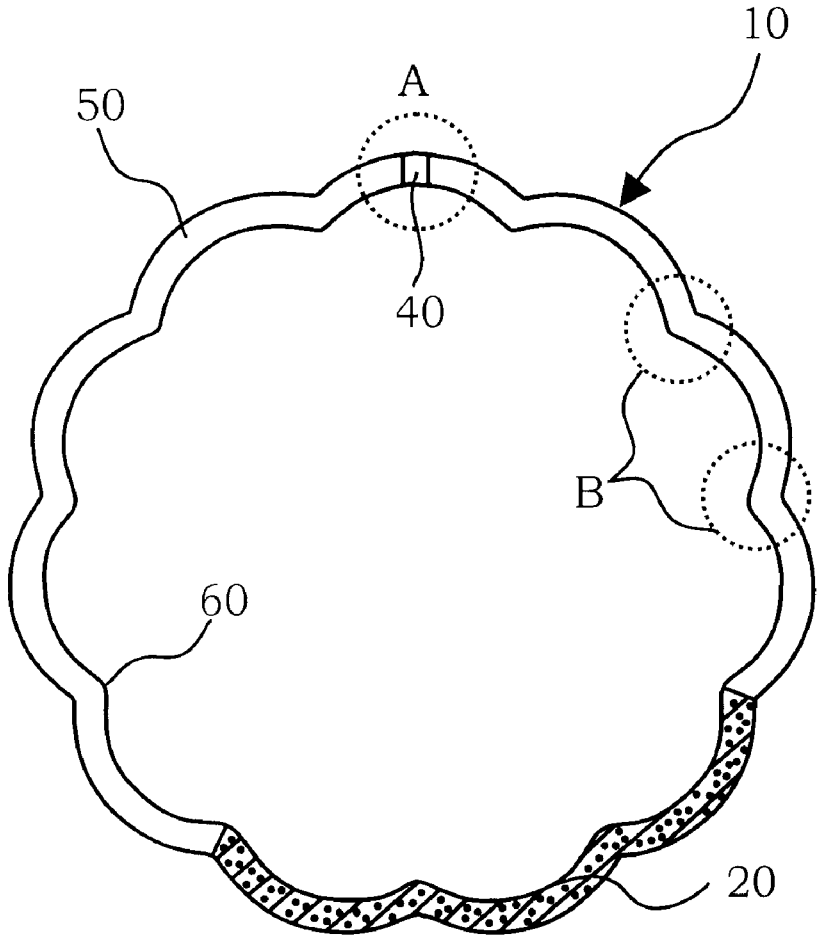
FIG. 3C is a front view of a floral hula hoop having solid particles in accordance with the third embodiment of the present invention.

The polygonal hula hoop of FIG. 2 provides the same operational effect, as formed by the bent portions 60 of the floral hula hoop of FIG. 3.

Different from conventional simply annular hula hoops providing only a simple rotating action, the structurally improved hula hoop of this invention provides improved physical exercising effect in addition to improved playing effect.

In addition, when infrared radiation tips, such as ceramic tips or jade tips, or magnetic tips are provided at the bent portions 60 of the floral hula hoop of this invention, the hoop provides magnetic massage effect and vital wave vibration effect in addition to active promotion of blood circulation.

As described above, the present invention provides a hula hoop having an annular, polygonal or floral shape and containing a fluid filler, such as a liquid- or solid-phase fluid filler, within its tubular body while leaving an empty space in the body, thus being improved in its functional effect when used for physical exercise or in play.

During a rotating action of a floral hula hoop according to the third embodiment of this invention about the body of a user, the fluid filler dynamically moves within the tubular hoop body due to both centrifugal force and rotating force, and repeatedly and intermittently transmits dynamic vibration to the body of the user. In addition, the floral hula hoop of this invention gives skin and muscle massaging and stimulating effect to the body of the user at its inward bent portions, thus actively promoting blood circulation and providing a vital wave vibration effect. This finally enhances both intestinal motility and intestinal function, and allows the user to smoothly and periodically evacuate the bowels.

Due to the dynamic movement of the filler within the cavity of the tubular hoop body, the hoop body is more dynamically rotated about the waist while transmitting effective pressure and vibration to the waist, thus forcing the subcutaneous fat layer of the waist to have dynamic physical exercise. This finally results in an effective removal of the subcutaneous fat from the layer. When the hula hoop is provided with healthful magnetic tips, ceramic tips or jade tips at its body, the hoop effectively relieves lumbago and menstrual pain.

When the hoop body of this invention is designed to have a floral profile, with a plurality of specified rubber pads fitted over the bent portions of the floral hoop body, the hoop body is less likely to slip down the body of the user while playing with the hoop, in addition to repeatedly giving dynamic massage effect to the body of the user as described in conjunction with FIG. 6.

In the present invention, the hoop body may be fabricated using a plurality of modules designed to be easily assembled and disassembled at a plurality of screwed joints. In such a case, it is easy for a user to freely select a desired fluid filler from liquid- or solid-phase fluid fillers and to selectively add or remove a desired amount of filler into or from the cavity of the tubular hoop body. In addition, the modular design of the hoop body allows a user to easily carry and store the hoop.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A floral hula hoop, comprising a tubular type floral hoop body, having a plurality of outward arc-shaped portions continuously and integrally formed along the floral hoop body, having a plurality of inwardly bent portions that are formed at the junctions of the outward arc-shaped portions, thus the arc-shaped portions and the bent portions are alternately formed along the floral hoop body, having a screwed joint that is formed on at least one arc-shaped portion of the floral hoop body, with a fluid filler contained in a cavity of said floral hoop body while leaving an empty space in said cavity.

2. The floral hula hoop according to claim 1, wherein said fluid filler is water.

3. The floral hula hoop according to claim 1, wherein said fluid filler is brine.

4. The floral hula hoop according to claim 1, wherein said fluid filler comprises a plurality of small metal balls.

5. The floral hula hoop according to claim 1, wherein said fluid filler comprises solid particles and liquid within the floral hoop body.

* * * * *